US007156798B2

(12) United States Patent
Jaquet et al.

(10) Patent No.: US 7,156,798 B2
(45) Date of Patent: Jan. 2, 2007

(54) BLANKING STATION OF A DIECUTTING PRESS

(75) Inventors: Bernard Jaquet, Rue (CH); Raphael Laederach, Vuisternens-devant-Romont (CH); Jean-Marc Limat, Bulle (CH)

(73) Assignee: Bobst S.A. (CH)

( * ) Notice: Subject to any disclaimer, the term of this patent is extended or adjusted under 35 U.S.C. 154(b) by 146 days.

(21) Appl. No.: 10/965,041

(22) Filed: Oct. 13, 2004

(65) Prior Publication Data

US 2005/0076761 A1 Apr. 14, 2005

(30) Foreign Application Priority Data

Oct. 14, 2003 (CH) ..... 1748/03

(51) Int. Cl.
*B31B 1/14* (2006.01)

(52) U.S. Cl. ..... 493/340; 493/206; 493/143

(58) Field of Classification Search ..... 493/340, 493/206, 142, 143, 144, 145, 147; 83/103, 83/698.11

See application file for complete search history.

(56) References Cited

U.S. PATENT DOCUMENTS 3,611,885 A * 10/1971 Paxton ..... 493/142
3,809,390 A 5/1974 Lenoir ..... 271/204
4,175,477 A * 11/1979 Inose et al. ..... 493/362
5,072,507 A * 12/1991 Meeks ..... 483/1
5,152,204 A * 10/1992 Trevizo ..... 83/55
5,154,689 A * 10/1992 Modoux et al. ..... 493/342
5,605,527 A * 2/1997 Gillieron ..... 493/342
5,784,939 A * 7/1998 Rebeaud ..... 83/563
5,810,233 A * 9/1998 Varidel ..... 225/97
6,095,962 A * 8/2000 Rebeaud ..... 493/373
6,718,856 B1 * 4/2004 De Dompierre et al. ..... 83/103
2001/0042451 A1 11/2001 Dompierre ..... 100/94

* cited by examiner

*Primary Examiner*—Sameh H. Tawfik
(74) *Attorney, Agent, or Firm*—Ostrolenk, Faber, Gerb & Soffen, LLP

(57) ABSTRACT

The blanking station of a diecutting press comprises an upper cradle for a blanking device and gripper bars for conveying the sheets in progress. This upper cradle includes devices for the removable mounting alternately of a blanking device or of a delivery device of non-severed sheets. At least one cam for opening grippers of the said gripper bars, and the cam is mounted in a removable manner.

7 Claims, 3 Drawing Sheets

Coupe II-II

BLANKING STATION OF A DIECUTTING PRESS

BACKGROUND OF THE INVENTION

The present invention refers to a blanking station of a diecutting press, comprising an upper cradle for a blanking device and gripper bars for conveying the sheets in progress.

When diecutting sheets in a diecutting press, according to the kind of job carried out on the press, it is possible to collect the blanks separately in distinct piles or to deliver the non-severed sheet if is to be processed in another machine, before or after the sheet diecutting operation and before the blanking operation.

In the first case, the leading edges of the respective sheets remain seized in the grippers of the gripper bar of the sheet conveying device and the waste from the sheets, after separating of the blanks, is led by the gripper bar towards the waste removal station.

In the second case, the sheet is released by the gripper bar and delivered to be piled up on a single storage pile formed between vertical jogging stops adjusted to the format of the sheets to be piled up.

As can be noted, the two aforesaid operating modes require respective specific means and can thus not be used in a station comprising multi-purpose means. Furthermore, the blanking only needs a tool moved by the alternate movements of the upper cradle of the blanking station, but the delivery device of non-severed sheets requires a movable means for the release of the sheets from the grippers and their guiding inside a storage frame. In fact, the movable means must be able to be lowered underneath the level of the gripper bar. Since it has to retain and push the leading edges of the sheets when the grippers of the gripper bar open, the movable means must be formed like a comb in order to pass between the grippers and the bar profile holding these grippers. Thus, this movable sheet delivery means has to be moved with respect to the cradle so that actuating means must be provided for moving the movable means in accordance with the movement of the upper cradle of the blanking station.

SUMMARY OF THE INVENTION

The object of the present invention is to carry out, at the same station of a diecutting press, according to the need, the blanking or the delivery of non-severed sheets.

To this end, the present invention relates to a blanking station of a diecutting press. The blanking station of a diecutting press comprises an upper cradle for a blanking device and gripper bars for conveying the sheets in progress. This upper cradle includes devices for the removable mounting alternately of a blanking device or of a delivery device of non-severed sheets. At least one cam for opening grippers of the said gripper bars, and the cam is mounted in a removable manner.

The first advantage of the invention is to render the use of the diecutting press more flexible. This solution leads to an investment economy and an optimal use of the machine production capacity.

Further features and advantages of this invention will become evident from the reading of the following description and from the enclosed drawings illustrating, schematically and by way of example, an embodiment of the blanking station of a diecutting press according to the present invention.

DESCRIPTION OF A PREFERRED EMBODIMENT

Figure 1:
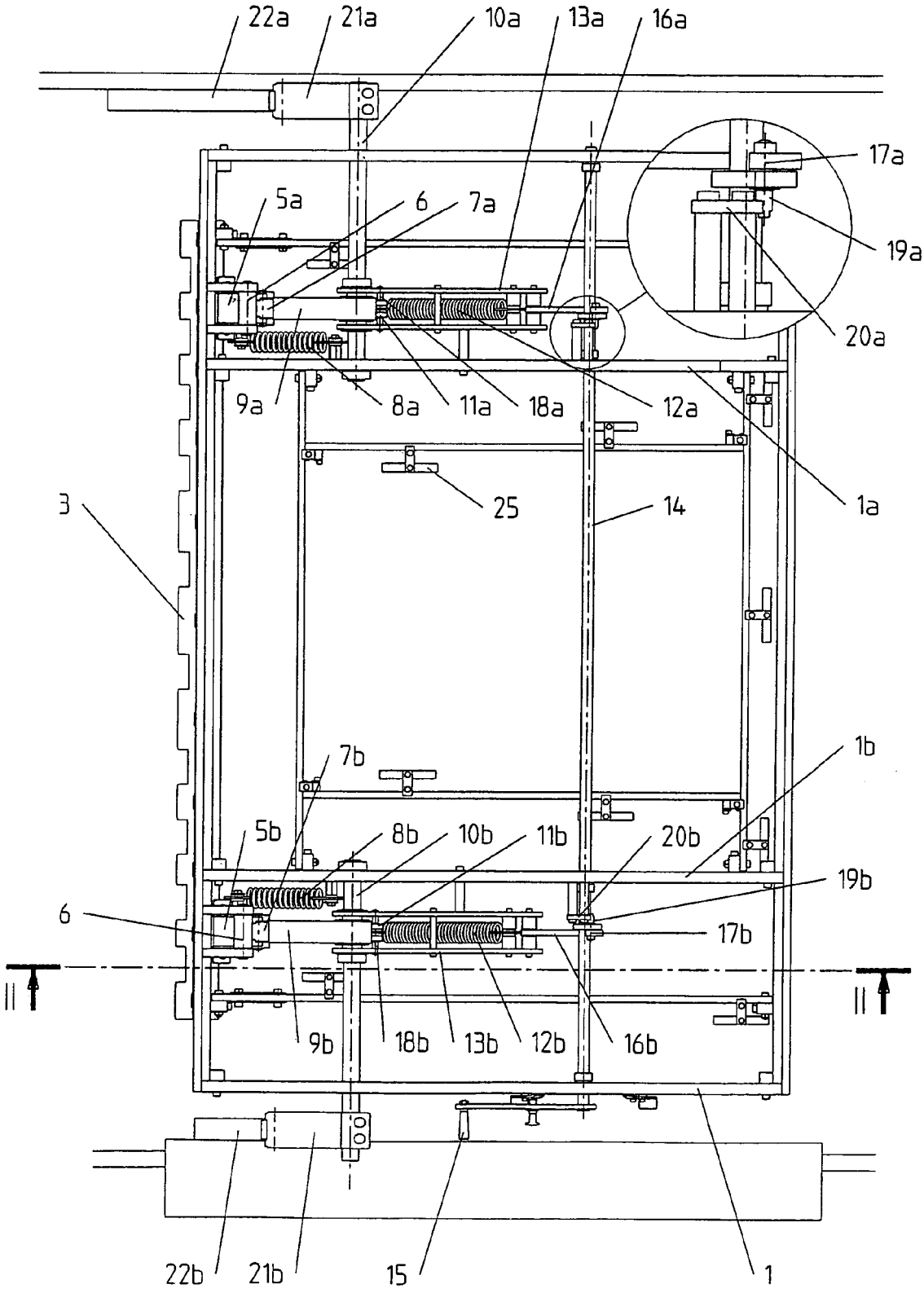
FIG. 1 is a top view of a blanking station with the delivery device of non-severed sheets.
Figure 2:
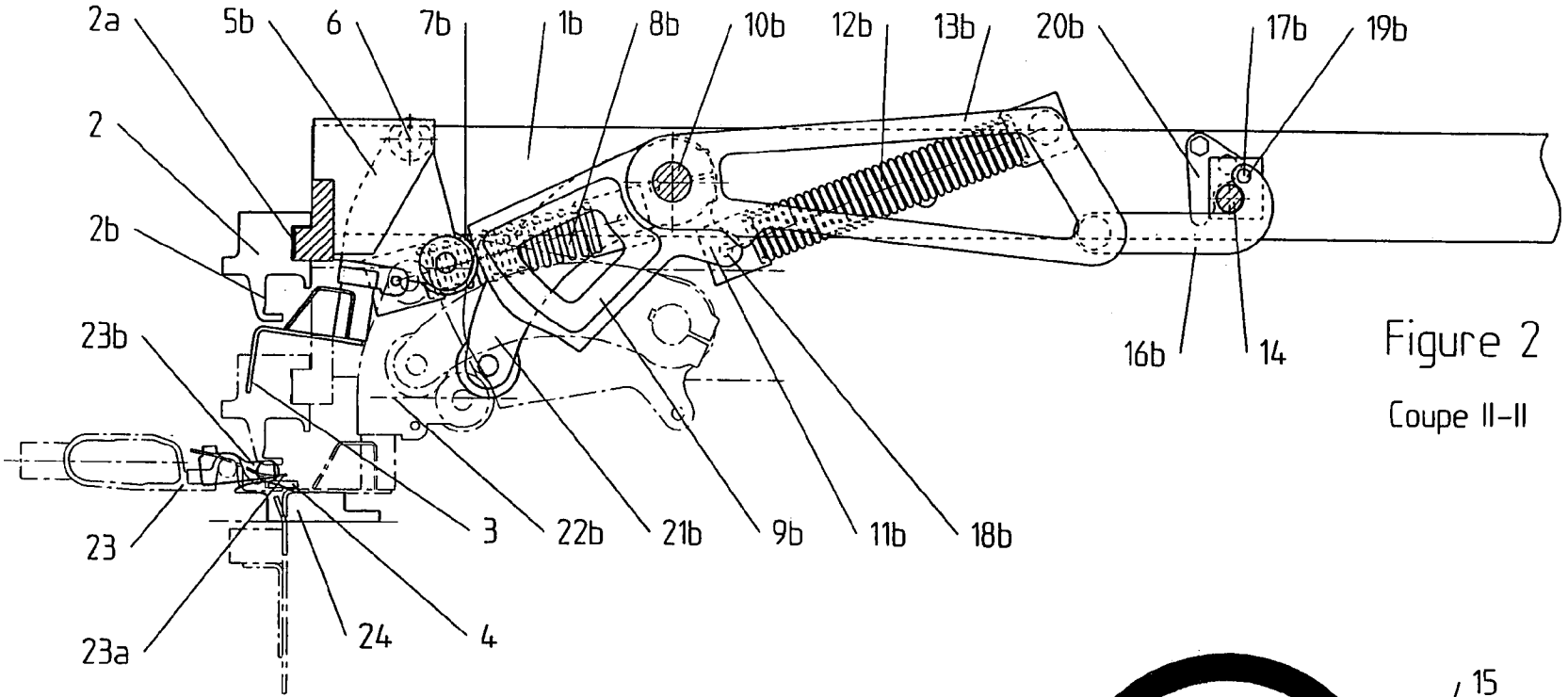
FIG. 2 is a sectional view along the line II—II of FIG. 1.

FIGS. 1 and 2 show a delivery device of non-severed sheets mounted on the separating station of blanks diecut by the diecutting press.

The delivery device of non-severed sheets comprises a rectangular frame 1 slidably mounted in a slide 2*a* of a chase member or upper cradle 2 of the blanking station, of which only the chase member is illustrated in FIG. 2. The rectangular frame 1 can thus be laterally positioned by sliding or can be removed from the separating station, from the operator's side of the machine depending on whether the diecut sheets with the diecut blanks attached to one another are to be collected in order to undergo one or a plurality of operations in another machine or the diecut blanks are to be separated and collected in distinct piles or stacks. In this case, the frame 1 has to be removed and another frame, or the "board" blanking tool, has to be slid into the slides 2*a* of the upper cradle 2. That other frame or "board" tool has not been shown since it is simply moved by the alternate vertical movements of the upper cradle 2 controlled by the drive mechanism of the diecutting press. Thus, this blanking frame does not differ from a conventional frame.

Contrary to the frame of the blanking device, the frame 1 of the non-severed sheet delivery device comprises an ejector member 3 which extends on the whole length of the front transverse side of the frame 1, with respect to the traveling direction of the diecut sheets 4, conveyed by the gripper bar 23 (FIG. 2) conventionally driven by two chains (not shown) in endless loops respectively arranged on both sides of the diecutting press to which are fixed the two ends of the gripper bar 23.

The ejector member 3 is fixedly attached to two link members 5*a*, 5*b* (FIG. 1) which are pivotally mounted about a transverse axis 6. Each link member 5*a*, 5*b* comprises a roller 7*a*, 7*b* pressed by a traction spring 8*a*, 8*b* against a cam 9*a*, 9*b* fixedly attached to a swivelling shaft 10*a*, 10*b*. Each cam 9*a*, 9*b* has an arm 11*a*, 11*b* to which an end of a spring 12*a*, 12*b* is fixed. The other end of the spring is fixed to a locking member 13*a*, 13*b*, pivotally mounted about the swivelling shaft 10*a*, 10*b* of the respective cams 9*a*, 9*b*.

Each locking member 13*a*, 13*b* is connected to the shaft 14 of a crank 15 by an arm 16*a*, 16*b*, having one end linked to the locking member 13*a*, respectively 13*b* and another end linked to an axis 17*a*, 17*b* distinct from the shaft 14 of the crank 15. A stop 18*a*, 18*b* fixedly attached to the cam 9*a*, respectively 9*b*, extends in the trajectory or path of the locking member 13*a*, 13*b*. A movable stop 19*a*, 19*b* offset with respect to the shaft 14 extends up to the crank 15 and is attached by the axis 17*a*, 17*b* to each arm 16*a*, respectively 16*b*. A fixed stop 20*a*, 20*b*, fixed by distance pieces 1*a*, 1*b* to the frame 1, is arranged in the trajectory or path of each movable stop 19*a*, 19*b*, limiting the movement of each locking member 13*a*, 13*b* under the effect of the traction of the spring 12*a*, respectively 12*b*.

Each shaft 10*a*, 10*b* is also fixedly attached to a drive lever 21*a*, 21*b*, which ends in a roller adapted to come into contact with a horizontal support surface 22*a*, 22*b*. Moving vertically alternately from top to bottom and inversely, the upper cradle 2 pivots the drive levers 21*a*, 21*b*, in the clockwise direction when the upper cradle 2 lowers and the springs 12*a*, 12*b* pivot them in the opposite direction when the cradle 2 rises. The movement of the drive levers in the opposite direction results from the resilience of the springs 12*a*, 12*b* which are tightened during movement of the shafts 10*a*, 10*b*. These directions of rotation can be observed with reference to FIGS. 2 and 3.

During the movement of the drive levers 21*a*, 21*b* in the clockwise direction, the cams 9*a*, 9*b* are driven in the same direction. Since the radius of the parts of these cams 9*a*, 9*b*, against which the rollers 7*a*, respectively 7*b* rest, decrease when they have been driven from the maximum angle value of the drive levers 21*a*, 21*b*, the link members 5*a*, 5*b* both pivot under the traction of the springs 8*a*, 8*b*. Consequently, the ejector member 3 rotates during the lowering of the upper cradle 2 so as to be brought into the lowered position shown in dot-and-dash lines in FIG. 2.

This movement of the comb-like ejector member 3 has to be accurately synchronized with the movement from the right to the left (FIG. 2) of the gripper bar 23 and with the opening of the grippers 23*a*. This opening is realized in conventional manner in this kind of machine, by a cam 24 (FIG. 2) arranged in the trajectory or path of the roller lever 23*b* for opening the grippers 23*a* of the gripper bar 23. Thus, the teeth of the comb which forms the ejector member 3 pass between the grippers 23*a* of the gripper bar 23, so that the leading edge of the sheet 4 is pushed by the ejector member 3 as soon as the sheet is released by the gripper bar 23.

In the case of a delivery station of non-severed sheets converted into a blanking station, the grippers 23*a* of the gripper bars are not allowed to be open in order to enable the gripper bar 23 to remove the remaining waste after the blanking. Therefore it must be possible to remove the cams 24 when converting the delivery station.

As can be noted on FIG. 2, the angular movement of the drive levers 21*a*, 21*b* is limited by the horizontal support surfaces 22*a*, 22*b*, so that if the frame 1 of the non-severed sheet delivery device should be slid in order to remove the upper cradle 2 and replace it by the blanking device (not shown), it is required to neutralize the springs 12*a*, 12*b* which rotate the drive levers 21*a*, 21*b* and the cams 9*a*, 9*b* fixedly attached to the same shaft 10*a*, respectively 10*b* and hinder the removal of the frame 1 from the delivery station.

Figure 3:
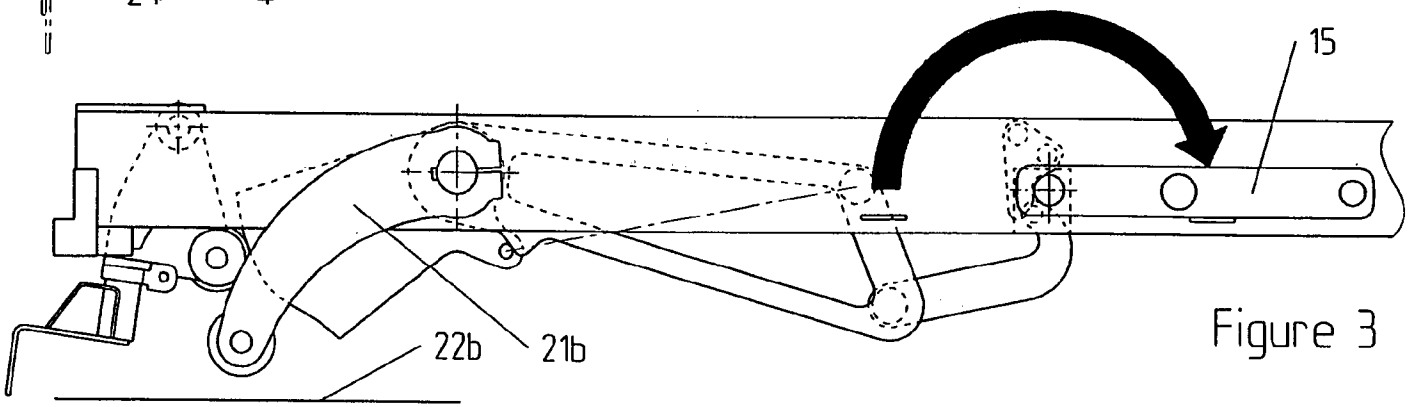
FIG. 3 is a side view similar to FIG. 2, illustrating the mechanism of the delivery device in its neutralized position.

To obtain this result, it is enough to rotate the crank 15 fixedly attached to the shaft 14 by 180° in the clockwise direction in order to change from its position shown in FIGS. 1, 2 to the position illustrated in FIG. 3. First, the traction of the springs 12*a*, 12*b*, which apply the movable stops 19*a*, 19*b* fixedly attached to the arms 16*a*, 16*b* against the fixed stops 20*a*, 20*b*, must be overcome. This movement of the crank causes a slight rotation of the locking members 13*a*, 13*b* of the springs 12*a*, 12*b* in the anticlockwise direction. Once the traction of the spring is overcome, it acts in the direction of rotation of the crank until the locking members 13*a*, 13*b* meet the stops 18*a*, 18*b* which are fixedly attached to the cams 9*a*, 9*b* and the drive levers 21*a*, 21*b* (FIG. 1) neutralizing the traction of the springs 12*a*, 12*b* on the crank 15. Finishing the half-rotation of this crank 15, the drive levers 21*a*, 21*b* are released from the horizontal support surfaces 22*a*, 22*b*, as can be seen in FIG. 3, thus allowing the removal of the frame 1 from the delivery device without interference of the drive levers 21*a*, 21*b*.

The delivery device 1 of the non-severed sheets 4 is further provided with a plurality of means 25 for accelerating the lowering of the sheets 4 after opening of the grippers 23*a*. These means 25 are distributed over the whole surface of the delivery device. They are located at a lower level than the frame 1, so as to come into contact with the surface of the delivered sheet 4, after opening of the grippers 23*a* of the gripper bar 23.

Figure 4:
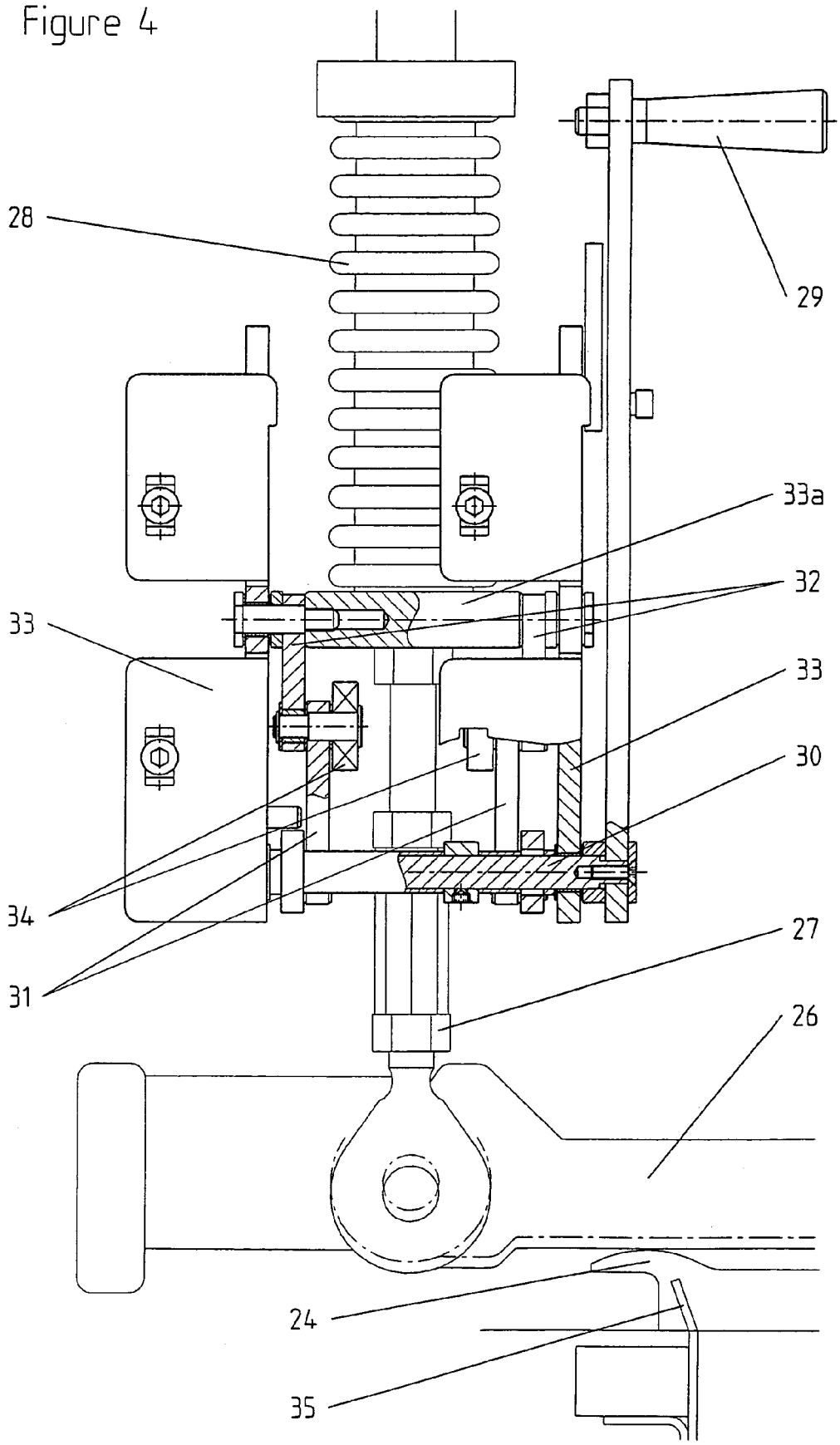
FIG. 4 is a side view of a lifting device of the chain guide of the driving device of the gripper bars.

Complementary to the device for "non-severed sheet delivery", the delivery station according to the present invention further comprises a lifting device of a portion of the guide chain 26 on the operator's side of the diecutting press, located in front of the cam for opening the grippers 23*a* of the gripper bar 23. This device is shown in FIG. 4.

For this purpose, the guide chain 26 has a movable portion hanging on a vertical rod 27 pressed towards its lowered position, which is illustrated in full line, by a compression spring 28. A control crank 29 is fixed to a swivelling shaft 30 extending parallel to the traveling direction of the diecut sheets 4, so that the crank moves in a transverse plane.

Two respective ends of two arms 31 are linked to a point offset with respect to the shaft 30. The two other respective ends of these two arms are linked to two other arms 32, and the two respective ends of the arms 32 are linked to the same support members 33 on which the crank 29 of the shaft 30 is pivoted. Two rollers 34 are pivoted on the same axis on which the two arms 31, 32 are linked together. Pulling the crank 29 towards him in the view shown in FIG. 4 which shows this crank 29 as being located with respect to the operator, the two arms 31, 32 raise the rollers 34 which at the limit of travel raise a shoulder of the rod 27 (not visible because hidden behind a distance piece 33*a* between the two members 33) on which rests the compression spring 28. This rod 27 is raised into the position illustrated in dot-and-dash lines on FIG. 4, so that the cam 24 for opening the grippers 23*a* of the gripper bar 23 is released.

With this device it is possible to remove the storage guides 35 of the delivered and piled up sheets 4, guides on which are fixed the cams 24 for opening the grippers 23*a* of the gripper bar 23. However, although this device is not absolutely necessary, it avoids the dismantling of the opening cams 24 and thus allows a gain in time.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A blanking station of a diecutting press, comprising:

an upper cradle for a blanking device;

gripper bars near the cradle including grippers for gripping sheets, the gripper bars being operable for conveying sheets in progress; wherein the upper cradle comprises means for removably mounting alternately the blanking device or a delivery device for non-severed sheets; and at least one cam for opening the grippers of the gripper bars, the cam being mounted in removable manner.

2. The blanking station according to claim 1, further comprising an ejector operable to eject the sheets, the ejector extending parallel to leading edges of the sheets being conveyed; wherein the ejector is linked about a transverse axis to the delivery device for non-severed sheets; and wherein the ejector comprises at least one spring for applying at least one member that is connected to the ejector of the sheets against at least one cam fixedly attached to at least one drive lever, and the movement of at least the drive lever is controlled by the movement of the upper cradle.

3. The blanking station according to claim 2, further comprising at least one stop surface fixed with respect to the upper cradle and at least one spring pressing the drive lever against the at least one stop surface.

4. The blanking station according to claim 3, wherein the drive lever has at least one linking member connected to a manual shut off control.

5. The blanking station according to claim 4, wherein the spring of the drive lever comprises a traction spring having one end fixedly attached to the drive lever and another end fixedly attached to at least one means that is pivotally mounted on the same axis as the drive lever; at least one linking member linking the at least one means to a crank, wherein angular movement of the crank is under influence of the traction spring and stops positioned for limiting the angular movement of the crank.

6. The blanking station according to claim 1, wherein the delivery device for non-severed sheets comprises means for pressing the non-severed sheets against a storage pile as they arrive at a separating/delivery station.

7. The blanking station according to claim 1, wherein the gripper bar has ends with two guiding rails arranged laterally and engaging the ends of the gripper bar, respectively, on both sides of the delivery device for the non-severed sheets; wherein the grippers include gripping jaws and the grippers engage the ends of the gripper bar;

the at least one cam which is operable for opening the grippers is arranged in a trajectory of a cam sensor that is fixedly attached to one of the jaws of the grippers; and the blanking station further comprising means for moving one of the guiding rails in order to enable the removal of the cam for opening the grippers to allow replacing of the delivery device for non-severed sheets with the blanking device.

* * * * *